US011776467B1

(12) United States Patent
Choi et al.

(10) Patent No.: US 11,776,467 B1
(45) Date of Patent: Oct. 3, 2023

(54) LED DRIVER CHIP CAPABLE OF BEING USED FOR BOTH MASTER CHIP AND SLAVE CHIP

(71) Applicant: TLI Inc., Seongnam-si (KR)

(72) Inventors: Jung Yeol Choi, Yongin-si (KR); Jin Wook Han, Seongnam-si (KR)

(73) Assignee: TLI INC., Seongnam-si (KR)

( * ) Notice: Subject to any disclaimer, the term of this patent is extended or adjusted under 35 U.S.C. 154(b) by 0 days.

(21) Appl. No.: 18/066,846

(22) Filed: Dec. 15, 2022

(30) Foreign Application Priority Data

Mar. 15, 2022 (KR) ..... 10-2022-0031835

(51) Int. Cl.
*G09G 3/30* (2006.01)
*G09G 3/32* (2016.01)

(52) U.S. Cl.
CPC ..... *G09G 3/32* (2013.01); *G09G 2310/0297* (2013.01); *G09G 2310/08* (2013.01)

(58) Field of Classification Search
CPC ..... G09G 3/32; G09G 2310/0297; G09G 2310/08
See application file for complete search history.

(56) References Cited

U.S. PATENT DOCUMENTS

2020/0312233 A1* 10/2020 Yen ..... G09G 3/3266
2021/0049956 A1* 2/2021 Yeh ..... G09G 5/008
2021/0118359 A1* 4/2021 Yeh ..... G09G 3/2003

* cited by examiner

*Primary Examiner* — Sanghyuk Park
(74) *Attorney, Agent, or Firm* — KILE PARK REED & HOUTTEMAN PLLC

(57) ABSTRACT

Disclosed herein is an LED driver chip capable of being used for master chip and slave chip. In case that the LED driver chip of the disclosure is used for the master, the strobe clock signal may be used as a reference clock signal. The 1-st to the n-th frequency clock signals, which are relatively simple to generate, may be provided as the 1-st to the n-th gray clock signals. In case that the LED driver chip of the disclosure is used for the slave, the external clock signal may be used as a reference clock signal. The 1-st to the n-th delay clock signals, which have a phase according to the reference clock signal, may be provided as the 1-st to the n-th gray clock signal. As a result, the LED driver chip of the disclosure can be used for both a master chip and a slave chip.

15 Claims, 7 Drawing Sheets

LED DRIVER CHIP CAPABLE OF BEING USED FOR BOTH MASTER CHIP AND SLAVE CHIP

CROSS-REFERENCE TO RELATED APPLICATION

This application claims priority to and the benefit of Korean Patent Application No. 10-2022-0031835 under 35 U.S.C. § 119, filed on Mar. 15, 2022, the disclosure of which is incorporated herein by reference in its entirety.

BACKGROUND

1. Technical Field

The disclosure relates to an LED driver chip, and more particularly, to a LED driver chip that is capable of being used for both a master chip and a slave chip.

2. Discussion of Related Art

In general, an LED display device is implemented to include an LED display panel and an LED driver chip. LED pixels are arranged on the LED display panel. The LED driver chip drives the LED display panel with a signal, current, voltage, etc. so that the LED pixels of the LED display panel display an appropriate image.

Meanwhile, LED display panels are becoming larger and larger. Accordingly, in order to drive an LED display panel, LED driver chips are coupled and disposed.

In this case, one of the LED driver chips operates as a master chip, and the rest operates as a slave chip. In this specification, the LED driver chip operating as a master chip is referred to as a "master LED driver chip," and the LED driver chip operating as a slave chip is referred to as a "slave LED driver chip."

The master LED driver chip may generate a reference clock signal that serves a reference for operation. The reference clock signal in the master LED driver chip acts as a reference for the gray clock signal, so that the LED pixels can display an image having various resolutions.

The slave LED driver chip receives a clock signal which is provided from the master LED driver chip. The slave LED driver chip uses the clock signal provided from the master LED driver chip as a reference clock signal, and generates its own gray clock signal. The gray clock signal of the slave LED driver chip and the reference clock signal have a same frequency.

Through such a master LED driver chip and the slave LED driver chip, the LED display system can display a high-quality image.

However, in this case, the master LED driver chip and the slave LED driver chip are different in structure. As a result, the master LED driver chip and the slave LED driver chip have to be separately manufactured.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

The disclosure is directed to a LED driver chip that is capable of being used for both a master chip and a slave chip.

According to an aspect of the disclosure, there is provided a LED driver chip that drives a display panel.

The LED driver chip according to the disclosure may comprise a clock reception node; a reference determination multiplexer that provides at least one of an external clock signal and a strobe clock signal as a reference clock signal, the external clock signal being received from an outside through the clock reception node; a gray clock generation part that generates a gray clock signal group, wherein the gray clock signal group corresponds to a delay clock signal group according to deactivation of an application selection signal, and corresponds to a frequency clock signal group according to activation of an application selection signal, the delay clock signal group includes a 1-st to a n-th delay clock signal which are sequentially delayed by a unit delay width with "n" being a natural number equal to or greater than 2, the frequency clock signal group includes a 1-st to a n-th frequency clock signals which are capable of being frequency-modulated with respect to the reference clock signal, frequencies of the 1-st to the n-th frequency clock signals are substantially identical to each other, the gray clock signal group includes a 1-st to a n-th gray clock signals; a clock modulation part that generates a modulation clock signal having a pulse width corresponding to a source data by using at least one of the 1-st to the n-th gray clock signals, the source data determining a light emission intensity of LED pixels disposed on the display panel; a data line driving part that drives a data line of the display panel with a current amount corresponding to a pulse width of the modulation clock signal; an output generation multiplexer that generates an output clock signal, the output clock signal being the n-th delay clock signal in case that the application selection signal is deactivated, and the output clock signal being the n-th frequency clock signal in case that the application selection signal is activated; and a clock output node that provides the output clock signal to the outside.

The source data may be provided from the outside in synchronization with the strobe clock signal.

The gray clock generation part may include delay locked loop that is enabled in response to deactivation of the application selection signal and generates the 1-st to the n-th delay clock signals, the 1-st to the n-th delay clock signals being sequentially delayed by the unit delay width with respect to the reference clock signal, and a phase of the n-th delay clock signal being substantially identical to a phase of the reference clock signal; a frequency locked loop that is enabled in response to activation of the application selection signal and generates the 1-st to the n-th frequency clock signals; and a loop selection multiplexer that provides the 1-st to the n-th delay clock signals as the 1-st to the n-th gray clock signals according to deactivation of the application selection signal, and provides the 1-st to the n-th frequency clock signals as the 1-st to the n-th gray clock signals according to activation of the application selection signal.

A data value of the source data may include a main code value and an additional code value, and the pulse width of the modulation clock signal may include a main activation width and an additional activation width.

The main activation width of the modulation clock signal may be a multiple of a clock width of the n-th gray clock signal, and the multiple of the clock width of the n-th gray clock signal may correspond to the main code value of the source data.

The additional activation width of the modulation clock signal may be determined by using the activation width of at least one of the 1-st to a n-th gray clock signals.

An LED display device may comprise a display panel; and LED driver chips that drives the display panel, each of the LED driver chips comprising: a clock reception node; a reference determination multiplexer that provides at least one of an external clock signal and a strobe clock signal as a reference clock signal, the external clock signal being received from an outside through the clock reception node; a gray clock generation part that generates a gray clock signal group, wherein the gray clock signal group corresponds to a delay clock signal group according to deactivation of an application selection signal, and corresponds to a frequency clock signal group according to activation of an application selection signal, the delay clock signal group includes a 1-st to a n-th delay clock signals which are sequentially delayed by a unit delay width with "n" being a natural number equal to or greater than 2, the frequency clock signal group includes a 1-st to a n-th frequency clock signals which are capable of being frequency-modulated with respect to the reference clock signal, frequencies of the 1-st to the n-th frequency clock signals are substantially identical to each other, and the gray clock signal group includes a 1-st to a n-th gray clock signals; a clock modulation part that generates a modulation clock signal having a pulse width corresponding to a source data by using at least one of the 1-st to the n-th gray clock signals, the source data determining a light emission intensity of LED pixels disposed on the display panel; a data line driving part that drives a data line of the display panel with a current amount corresponding to a pulse width of the modulation clock signal; an output generation multiplexer that generates an output clock signal, the output clock signal being the n-th delay clock signal in case that the application selection signal is deactivated, and the output clock signal being the n-th frequency clock signal in case that the application selection signal is activated; and a clock output node that provides the output clock signal to the outside.

The source data may be provided from the outside in synchronization with the strobe clock signal.

The gray clock generation part may include a delay locked loop that is enabled in response to deactivation of the application selection signal and generates the 1-st to the n-th delay clock signals, the 1-st to the n-th delay clock signals being sequentially delayed by the unit delay width with respect to the reference clock signal, and a phase of the n-th delay clock signal being substantially identical to a phase of the reference clock signal; a frequency locked loop that is enabled in response to activation of the application selection signal and generates the 1-st to the n-th frequency clock signals; and a loop selection multiplexer that provides the 1-st to the n-th delay clock signals as the 1-st to the n-th gray clock signals according to deactivation of the application selection signal, and provides the 1-st to the n-th frequency clock signals as the 1-st to the n-th gray clock signals according to activation of the application selection signal.

A data value of the source data may include a main code value and an additional code value, and the pulse width of the modulation clock signal includes a main activation width and an additional activation width.

The main activation width of the modulation clock signal may be a multiple of a clock width of the n-th gray clock signal, and the multiple of the clock width of the n-th gray clock signal may correspond to the main code value of the source data.

The additional activation width of the modulation clock signal may be determined by using the activation width of at least one of the 1-st to a n-th gray clock signals.

The LED driver chips may include a first LED driver chip that functions as a master driver chip; a second LED driver chip that functions as a slave driver chip; and a third LED driver chip that functions as another slave driver ship.

The first LED driver chip may be electrically connected to the second LED driver chip and the third LED driver chip, and the second LED driver chip and the third LED driver chip may be electrically connected in parallel.

The first LED driver chip may be electrically connected to the second LED driver chip, and the second LED driver chip may be electrically connected to the third LED driver chip.

BRIEF DESCRIPTION OF THE DRAWINGS

The above and other objects, features and advantages of the disclosure will become more apparent to those skilled in the art by describing in detail exemplary embodiments thereof with reference to the accompanying drawings, in which.

DETAILED DESCRIPTION OF THE EMBODIMENTS

Figure 1:
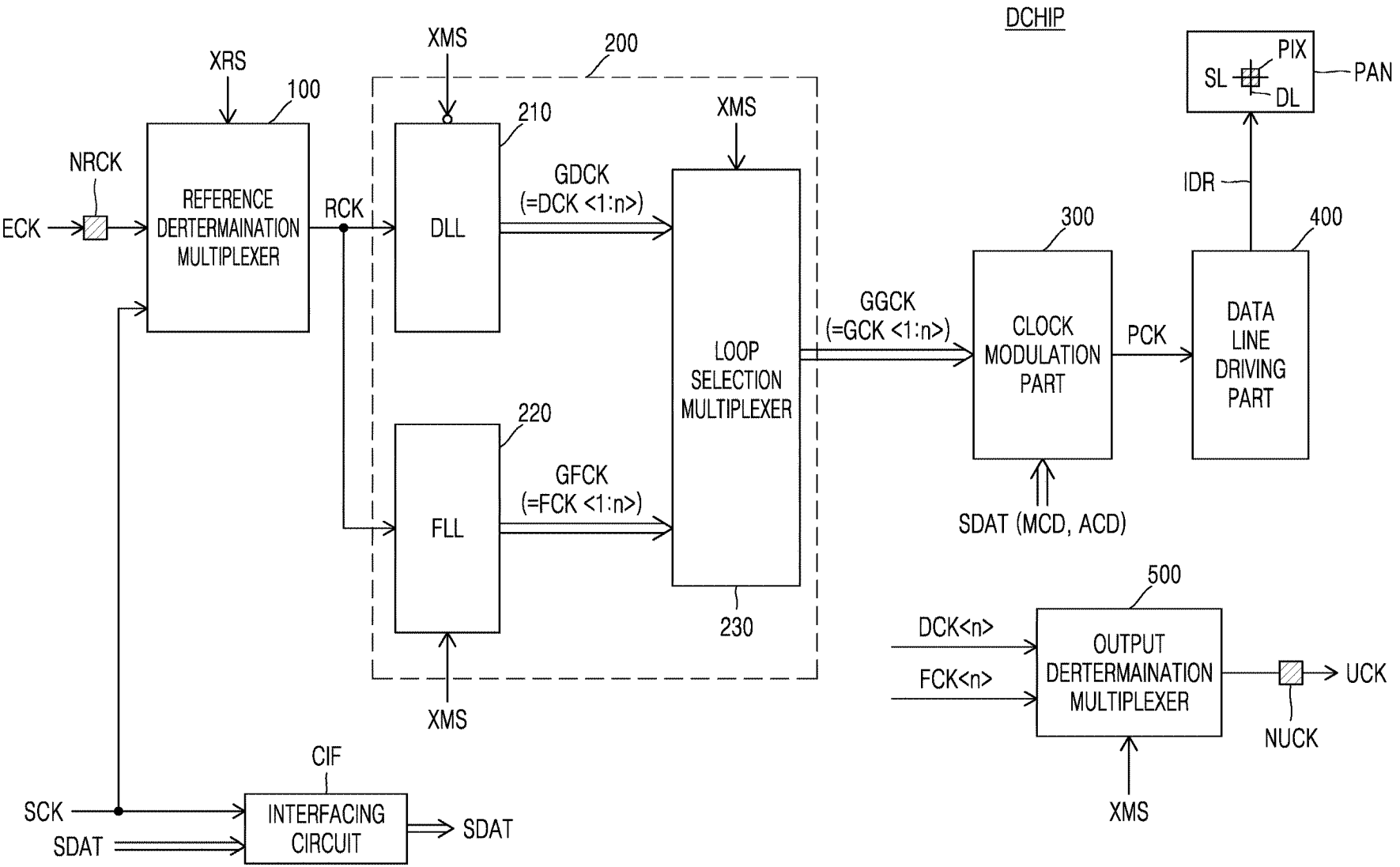
FIG. 1 is a schematic diagram illustrating the LED driver chip according to an embodiment of the disclosure.

Embodiments of the disclosure will be described as an example in detail below with reference to the accompanying drawings. While the disclosure is shown and described in connection with the embodiments thereof, it will be apparent to those skilled in the art that various modifications can be made without departing from the spirit and scope of the disclosure. Thus, the scope of the disclosure is not limited to these particular following embodiments.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the disclosure. Further, the blocks, units, and/or modules of some embodiments may be physically combined into more complex blocks, units, and/or modules without departing from the scope of the disclosure.

The terminology used herein is for the purpose of describing particular embodiments only and is not intended to be limiting of the disclosure. As used herein, the singular forms (e.g., "a" and "an") are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

A "width" of a signal as used herein may mean a "period" of a signal, and the "width" and "period" may be interchangeable herein.

The term "and/or" includes all combinations of one or more of which associated configurations may define. For example, "A and/or B" may be understood to mean "A, B, or A and B."

For the purposes of this disclosure, the phrase "at least one of A and B" may be construed as A only, B only, or any combination of A and B. Also, "at least one of X, Y, and Z" and "at least one selected from the group consisting of X, Y, and Z" may be construed as X only, Y only, Z only, or any combination of two or more of X, Y, and Z.

Unless otherwise defined or implied herein, all terms (including technical and scientific terms) used herein have the same meaning as commonly understood by those skilled in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or excessively formal sense unless clearly so defined herein.

Hereinafter, embodiment of the disclosure will be described in detail with reference to the accompanying drawings.

FIG. 1 is a diagram illustrating the LED driver chip DCHIP according to an embodiment of the disclosure. The LED driver chip DCHIP of the disclosure may drive a display panel PAN. LED pixels PIX, which are specified by the scan line SL and the data line DL, may be disposed in the display panel PAN.

Referring to FIG. 1, the LED driver chip DCHIP of the disclosure may comprise a clock reception node NRCK, a reference determination multiplexer 100, a gray clock generation part 200, a clock modulation part 300, a data line driving part 400 and an output generation multiplexer 500.

The reference determination multiplexer 100 may provide at least one of an external clock signal ECK and a strobe clock signal SCK as a reference clock signal RCK, depending on the logic state of a reference determination signal XRS.

Here, the external clock signal ECK may be received from the outside through the clock reception node NRCK. The strobe clock signal SCK may act as a reference when a source data SDAT is input. The source data SDAT may determine a light emission intensity of LED pixels PIX disposed on the display panel PAN.

In FIG. 1, an interfacing circuit CIF may provide the source data SDAT, which is input in synchronization with the strobe clock signal SCK, to the inside of the chip.

In case that the LED driver chip DCHIP of the disclosure is used as a master LED driver chip, the logic state of the reference determination signal XRS may be set as "H." In this case, the strobe clock signal SCK may be provided as the reference clock signal RCK.

In case that the LED driver chip DCHIP of the disclosure is used as a slave LED driver chip, the logic state of the reference determination signal XRS may be set as "L." In this case, the external clock signal ECK may be provided as the reference clock signal RCK.

In this specification, for simplicity of explanation, the detailed description of the implementation of the reference determination multiplexer 100 is omitted or simplified.

The gray clock generation part 200 may generate a gray clock signal group GGCK. At this time, the gray clock signal group GGCK corresponds to at least one of a delay clock signal group GDCK and a frequency clock signal group GFCK according to the logic state of an application selection signal XMS.

For example, in case that the LED driver chip DCHIP of the disclosure is used for the master LED driver chip, the logic state of an application selection signal XMS may be set as "H." The frequency clock signal group GFCK may be provided as the gray clock signal group GGCK.

In case that the LED driver chip DCHIP of the disclosure is used for the slave LED driver chip, the logic state of an application selection signal XMS may be set as "L." The delay clock signal group GDCK may be provided as the gray clock signal group GGCK.

In this embodiment, the delay clock signal group GDCK may include or consist of a 1-st to a n-th delay clock signals DCK<1:n>, and the frequency clock signal group GFCK may include or consist of a 1-st to a n-th frequency clock signals FCK<1:n>. The gray clock signal group GGCK may include or consist of a 1-st to a n-th gray clock signals GCK<1:n>. Here, "n" is a natural number equal to or more than 2.

The gray clock generation part 200 may include a delay locked loop 210, a frequency locked loop 220 and a loop selection multiplexer 230.

The delay locked loop 210 may be enabled in response to the deactivation of "L: of the application selection signal XMS, and the frequency locked loop 220 may be enabled in response to the activation of "H" of the application selection signal XMS.

Figure 2:
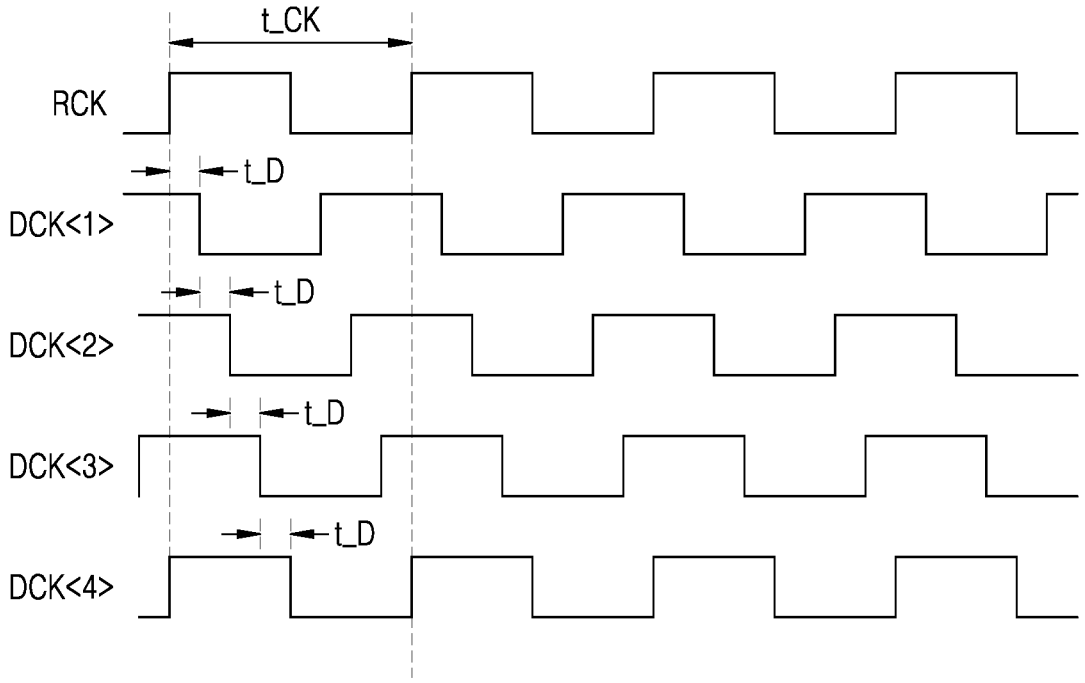
FIG. 2 is a schematic diagram for explaining the generation of the delay clock signals, in the LED driver chip of FIG. 1.

The delay locked loop 210 may generate the 1-st to the n-th delay clock signals DCK<1:n> by using the reference clock signal RCK. The 1-st to the n-th delay clock signals DCK<1:n> may be sequentially delayed by the unit delay width t_D with respect to the reference clock signal RCK, as shown in FIG. 2. In FIG. 2, an embodiment in which "n" is "4" is illustrated.

The n-th delay clock signal DCK<n> may be delayed 1 clock with respect to the reference clock signal RCK.

For example, the 1-st to the n-th delay clock signals DCK<1:n>, which are generated from the delay locked loop 210, and the reference clock signal RCK may have a same frequency. The n-th delay clock signal DCK<n> may be also in phase with the reference clock signal RCK.

In this specification, for simplicity of explanation, the detailed description of the implementation of the delay locked loop 210 is omitted or simplified.

The frequency locked loop 220 may generate the 1-st to the n-th frequency clock signals FCK<1:n> by using the reference clock signal RCK. The 1-st to the n-th frequency clock signals FCK<1:n> may be frequency-modulated with respect to the reference clock signals RCK. The frequencies of the 1-st to the n-th frequency clock signals FCK<1:n> may be the same.

Figure 3:
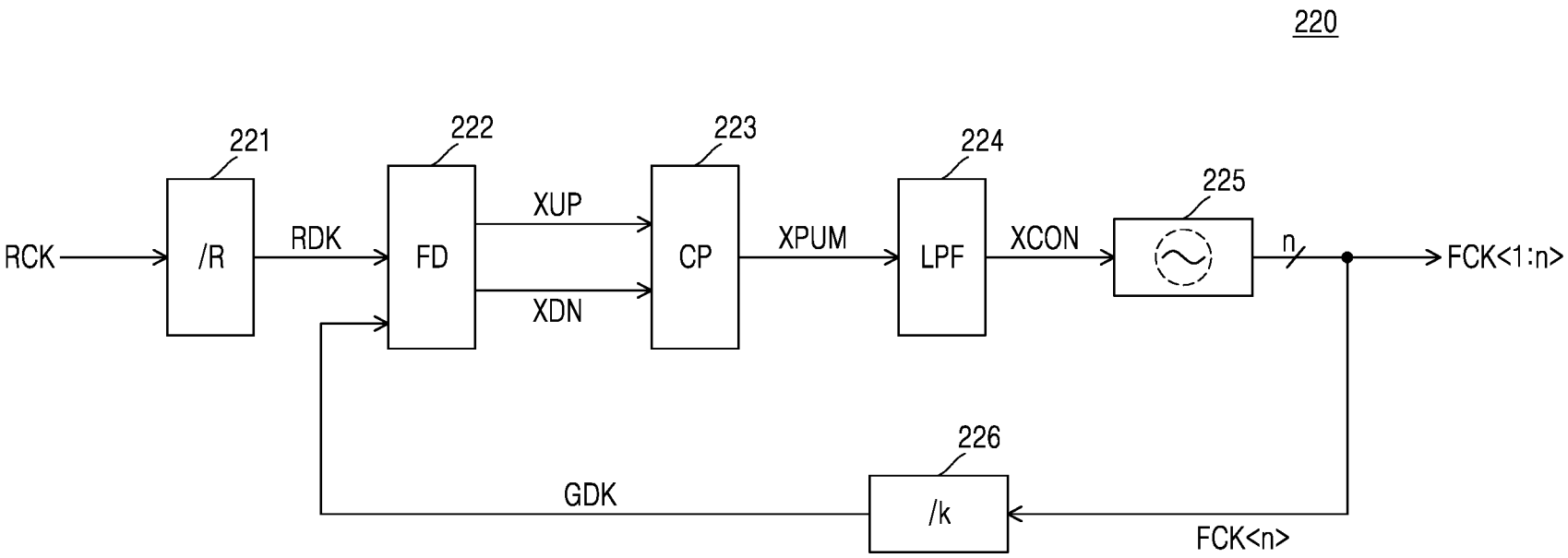
FIG. 3 is a schematic diagram illustrating an example of a frequency locked loop of FIG. 1.

FIG. 3 is a diagram illustrating an example of the frequency locked loop 220 of FIG. 1. Referring to FIG. 3, the frequency locked loop 220 may include a first division part (or first division unit) 221, a frequency detection part (or frequency detection unit) 222, a charge pumper 223, a low frequency filter 224, an oscillator 225, and a second division part (or second division unit) 226.

The first division part 221 may receive the reference clock signal RCK and may generate a reference division signal RDK. The reference division signal RDK may have a frequency divided by 1/R with respect to the frequency of the reference clock signal RCK.

The frequency detection part 222 may generate an up signal XUP and a down signal XDN by comparing frequencies between the reference division signal RDK and the gray division signal GDK. The logic states of the up signal XUP and the down signal XDN may depend on a frequency comparison result between the reference division signal RDK and the gray division signal GDK.

In this embodiment, in case that the frequency of the gray division signal GDK is smaller than the frequency of the reference division signal RDK, the pulse of the up signal XUP may be generated. In case that the frequency of the gray division signal GDK is greater than the frequency of the reference division signal RDK, the pulse of the down signal XDN may be generated.

The charge pumper 223 may receive the up signal XUP and the down signal XDN, and may generate a pumping signal XPUM. The voltage level of the pumping signal XPUM may increase according to the generation of the pulse of the up signal XUP, and may decrease according to the generation of the pulse of the down signal XDN.

The low-frequency filter 224 may generate a control signal XCON by filtering the low-frequency component of the pumping signal XPUM.

The oscillator 225 may generate the 1-st to the n-th frequency clock signals FCK<1:n>. Here, The frequencies of the 1-st to the n-th frequency clock signals FCK<1:n> may be controlled by the voltage level of the control signal XCON.

For example, as the voltage level of the control signal XCON are increased, the frequencies of the 1-st to the n-th frequency clock signals FCK<1:n> may be increased. As the voltage level of the control signal XCON are decreased, the frequencies of the 1-st to the n-th frequency clock signals FCK<1:n> may be decreased.

The second division part 226 may receive the n-th frequency clock signal FCLK<n> and may generate the gray division signal GDK. The gray division signal GDK may have a frequency divided by 1/R with respect to the frequency of the n-th frequency clock signal FCLK<n>.

A frequency F_fck of each of the 1-st to the n-th frequency clock signals FCK<1:n> is expressed below as Equation 1.

$$F_fck = F_rck * (k/R) \quad \text{(Equation 1)}$$

Here, "F_rck" represents the frequency of the reference clock signal RCK.

For example, the frequency F_fck of each of the 1-st to the n-th frequency clock signals FCK<1:n>, which are generated from the frequency locked loop 220, may be modulated as "k/R" with respect to the frequency of the reference clock signal RCK.

The frequencies F_fck of the 1-st to the n-th frequency clock signals FCK<1:n> may be the same.

Next, the 1-st to the n-th frequency clock signals FCK<1:n>, which are generated from the frequency locked loop 220, will be described.

Figure 4:
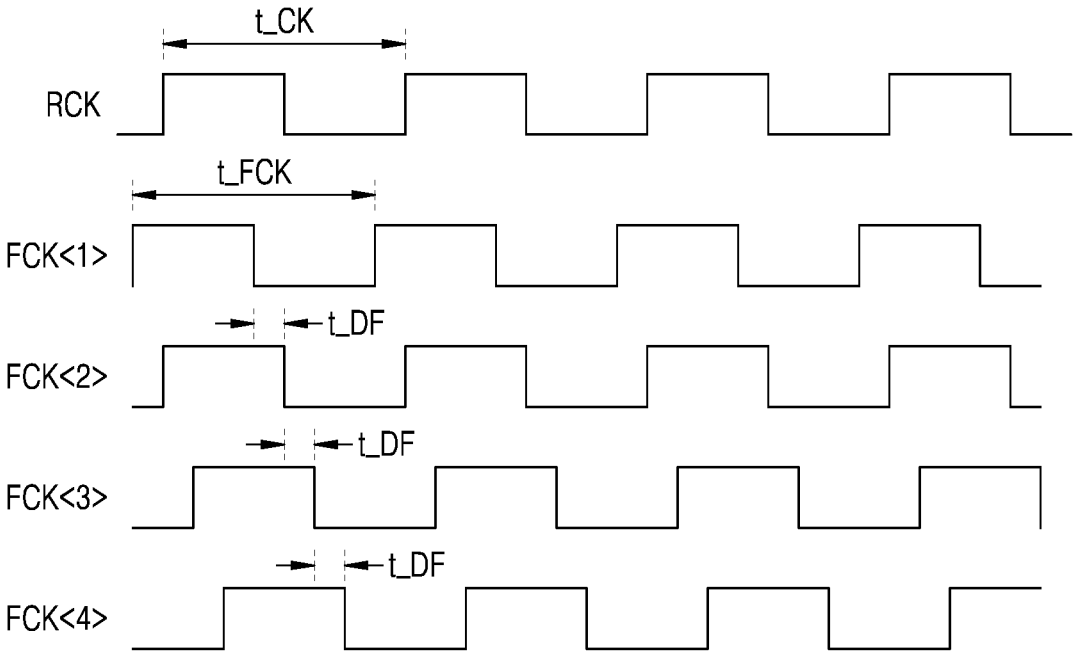
FIG. 4 is a schematic diagram for explaining the generation of the frequency clock signals, in the LED driver chip of FIG. 1.

In FIG. 4, an embodiment in which "n" is "4" is illustrated. The frequency unit delay width t_DF corresponds to ¼ of the period t_FCK of the 1-st to the n-th frequency clock signals FCK<1:n>.

Unlike the n-th delay clock signal DCK<n>, the delay width of the first frequency clock signal FCK<1> may not be constrained to the reference clock signal RCK.

Accordingly, the n-th frequency clock signal FCK<n> may also have a phase different from that of the reference clock signal RCK. The n-th frequency clock signal FCK<n> may be different from the n-th delay clock signal DCK<n>. For example, the phases of the 1-st to the n-th frequency clock signals FCK<1:n> may not be constrained to the reference clock signal RCK.

Therefore, the generation of the 1-st to the n-th frequency clock signals FCK<1:n> by the frequency locked loop 220 may be simpler than that of the 1-st to the n-th delay clock signals DCK<1:n> by the delay locked loop 210.

Referring again to FIG. 1, the loop selection multiplexer 230 may provide the 1-st to the n-th delay clock signals DCK<1:n> as the 1-st to the n-th gray clock signals GCK<1:n> according to deactivation of "L" of the application selection signal XMS. The loop selection multiplexer 230 may provide the 1-st to the n-th frequency clock signals FCK<1:n> as the 1-st to the n-th gray clock signals GCK<1:n> according to activation of "H" of the application selection signal XMS.

The clock modulation part 300 may generate a modulation clock signal PCK by using at least one of the 1-st to the n-th gray clock signals GCK<1:n>. In this embodiment, the clock modulation part 300 may use the 4-th gray clock signal GCK<4> together with the 1-st to the 3-rd gray clock signals GCK<1:3> to generate the modulation clock signal PCK.

The pulse width of the modulation clock signal PCK may correspond to a source data SDAT. Here, the source data SDAT may determine a light emission intensity of LED pixels PIX disposed on the display panel PAN.

Figure 6:
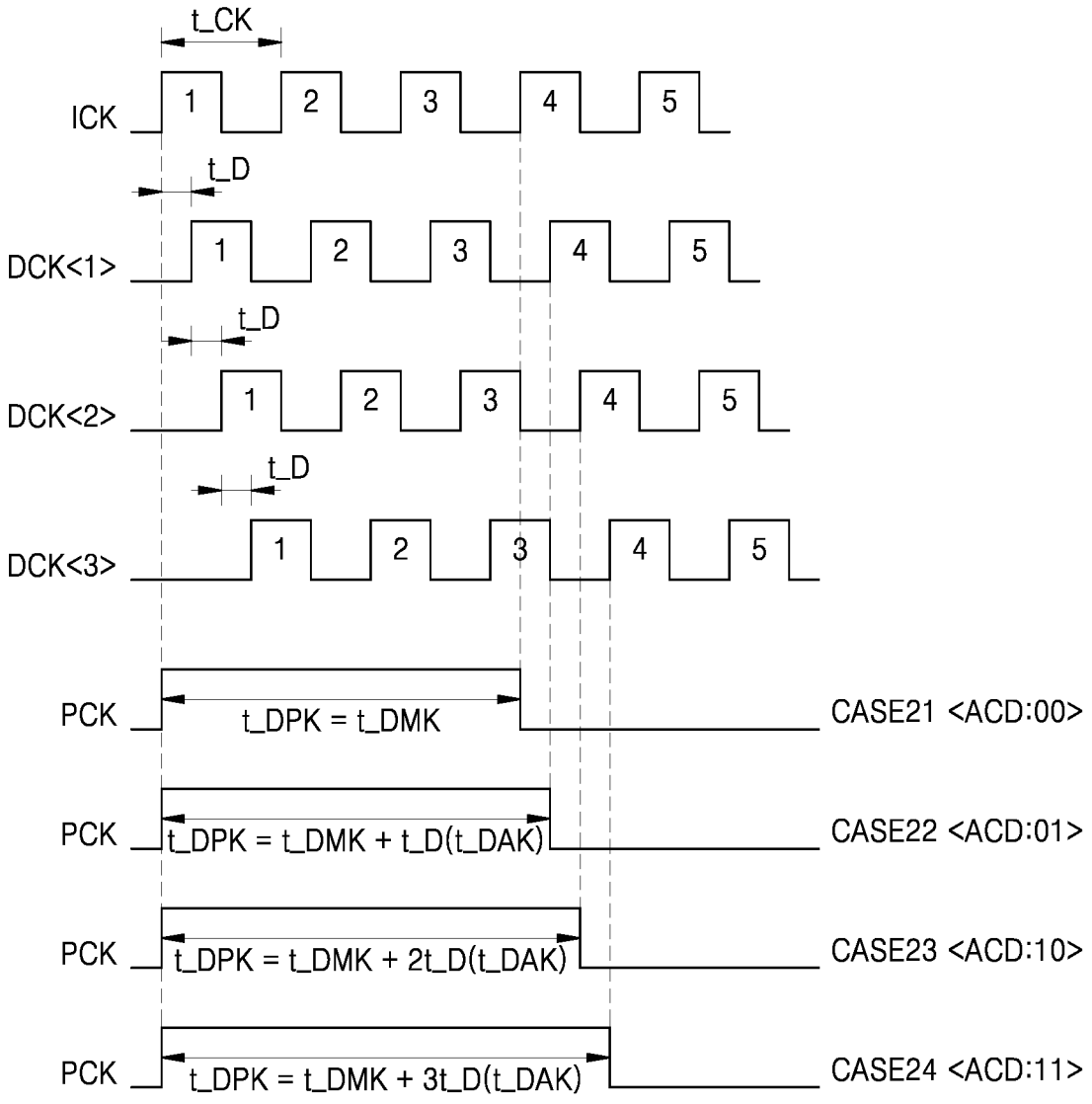
FIG. 6 is a schematic diagram for explaining the additional activation width of a modulation clock signal according to an additional code value of the source data, in the LED driver chip of FIG. 1.

The data value of the source data SDAT may include or consist of a main code value MCD and an additional code value ACD. The main code value MCD may be generated by the upper bits of the source data SDAT, and the additional code value ACD may be generated by the lower bits of the source data SDAT The activation width t_DPK of the modulation clock signal PCK may include or consist of only the main activation width t_DMK, as shown in FIG. 6. The activation width t_DPK of the modulation clock signal PCK may be formed by adding the additional activation width t_DAK to the main activation width t_DMK, as shown in FIG. 6.

The data line driving part 400 may drive a data line DL of the display panel PAN with a current amount corresponding to the pulse width of the modulation clock signal PCK.

Subsequently, the activation width t_DPK of the modulation clock signal PCK, which is generated from the clock modulation part 300, will be described in detail.

Figure 5:
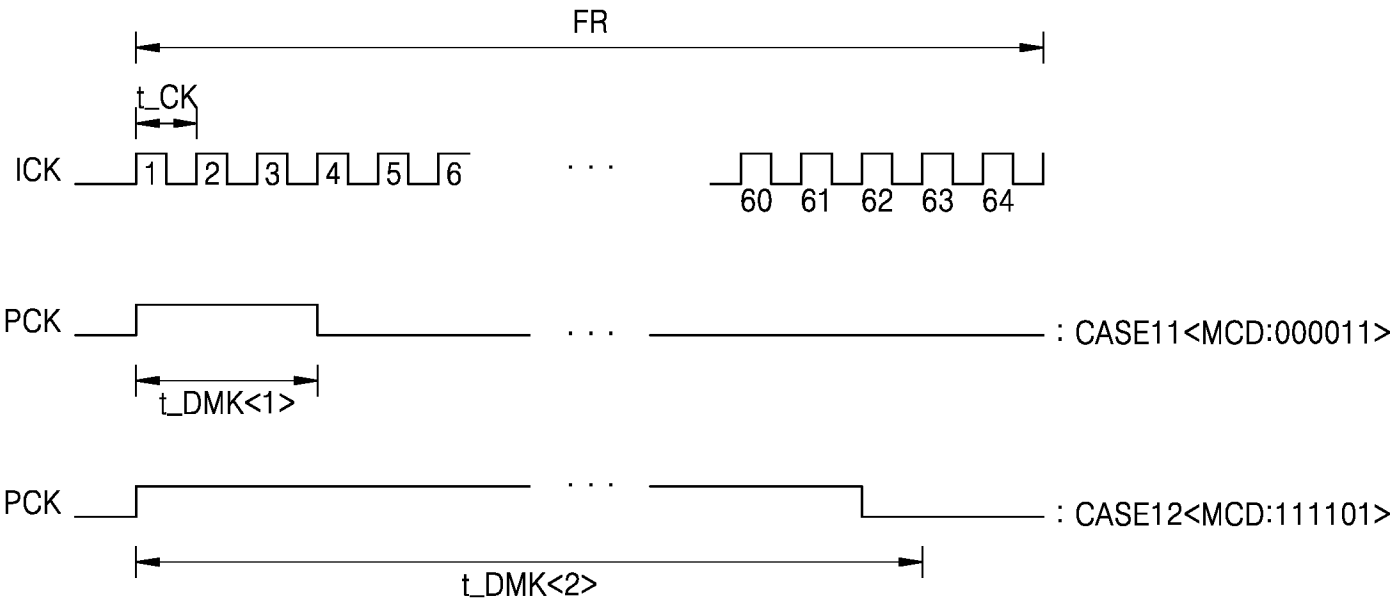
FIG. 5 is a schematic diagram for explaining the main activation width of a modulation clock signal according to a main code value of the source data, in the LED driver chip of FIG. 1.

As shown in FIG. 5, the main activation width t_DMK of the modulation clock PCK may be a multiple of a clock width t_CK of the 4-th gray clock signal GCK<4>, and the multiple of the clock width t_CK of the 4-th gray clock signal GCK<4> may correspond to the main code value MCD of the source data SDAT.

In the example of FIG. 5, a frame FR forming an image may correspond to 64 clock widths t_CK.

In case that the main code value MCD of the source data is <000011> as in CASE11, the main activation width t_DMK<1> of the modulation clock signal PCK may correspond to 3 times the clock width t_CK of the 4-th gray clock signal GCK<4>. In case that the main code value MCD of the source data is <111101> as in CASE12, the main activation width t_DMK<2> of the modulation clock signal PCK may correspond to 61 times the clock width t_CK of the 4-th gray clock signal GCK<4>.

In other words, in the example of FIG. 5, the main code value MCD of the source data SDAT may have a maximum of 6 bits, and the main activation width t_DMK of the modulation clock signal PCK may be one of 64 types. For example, in case that the brightness of the LED pixel PIX is determined only by the main code value MCD of the source data SDAT, 64 types may be displayed.

However, in the LED driver chip DCHIP of the disclosure, as shown in FIG. 6, the activation width t_DPK of the modulation clock signal PCK may be determined by adding the additional activation width t_DAK to the main activation width t_DMK.

FIG. 6 is a diagram for explaining the additional activation width t_DAK of a modulation clock signal PCK according to the additional code value ACD of the source data SDAT. In the example of FIG. 6, it is assumed that the main code value MCD of the source data SDAT is <000011>.

In CASE 21, the additional code value ACD of the source data SDAT is <00>, and the entire code value of the source data SDAT is <00001100>. In this case, the activation width t_DPK of the modulation clock signal PCK may be the interval between the rising edge of the 1-st clock and the rising edge of the 4-th clock in the 4-th gray clock signal GCK<4>. For example, the activation width t_DPK of the modulation clock signal PCK may be substantially equal to the main activation width t_DMK. In this case, the additional activation width t_DAK may correspond to "0."

In CASE 22, the additional code value ACD of the source data SDAT is <01>, and the entire code value of the source data SDAT is <00001101>. In this case, the activation width t_DPK of the modulation clock signal PCK may be the interval between the rising edge of the 1-st clock in the 4-th gray clock signal GCK<4> and the rising edge of the 4-th clock in the 1-st gray clock signal GCK<1>. For example, the activation width t_DPK of the modulation clock signal PCK may be substantially equal to the main activation width t_DMK plus 1-times unit delay width t_D. In this case, the additional activation width t_DAK may correspond to "1*t_D."

In CASE 23, the additional code value ACD of the source data SDAT is <10>, and the entire code value of the source data SDAT is <00001110>. In this case, the activation width t_DPK of the modulation clock signal PCK may be the interval between the rising edge of the 1-st clock in the 4-th gray clock signal GCK<4> and the rising edge of the 4-th clock in the 2-nd gray clock signal GCK<2>. For example, the activation width t_DPK of the modulation clock signal PCK may be substantially equal to the main activation width t_DMK plus 2-times unit delay width t_D. In this case, the additional activation width t_DAK may correspond to "2*t_D."

In CASE 24, the additional code value ACD of the source data SDAT is <11>, and the entire code value of the source data SDAT is <00001111>. In this case, the activation width t_DPK of the modulation clock signal PCK may be the interval between the rising edge of the 1-st clock in the 4-th gray clock signal GCK<4> and the rising edge of the 4-th clock in the 3-rd gray clock signal GCK<3>. For example, the activation width t_DPK of the modulation clock signal PCK may be substantially equal to the main activation width t_DMK plus 3-times unit delay width t_D. In this case, the additional activation width t_DAK may correspond to "3*t_D."

For example, the additional activation width t_DAK of the modulation clock signal PCK may be determined by using the activation width of one of the 1-st to a (n−1)-th gray clock signals GGCK<1:n−1>.

In summary, in the LED driver chip DCHIP of the disclosure as described above, the code value of the source data SDAT may be the sum of the main code value MCD corresponding to the bit value of the 6-bit and the additional code value ACD corresponding to the bit value of the 2-bit. As a result, the source data SDAT may be the same as being composed of all 8-bit.

Accordingly, the LED pixel PIX of the display panel PAN driven by the LED driver chip DCHIP of the disclosure can be controlled with 256 type brightness of 8-bit instead of 64 type brightness of 6-bit.

As a result, the display panel PAN driven the LED driver chip DCHIL of the disclosure can display an image with high color grayscale resolution.

Referring again to FIG. 1, the output generation multiplexer 500 may provide at least one of the n-th delay clock signal DCK<n> and the n-th frequency clock signal FCK<n> as an output clock signal UCK. The output clock signal UCK may be the n-th delay clock signal DCK<n> in case that the application selection signal XMS is deactivated to "L." The output clock signal UCK may be the n-th frequency clock signal FCK<n> in case that the application selection signal is activated to "H."

The clock output node NUCK may provide the output clock signal UCK to the outside.

Figure 7:
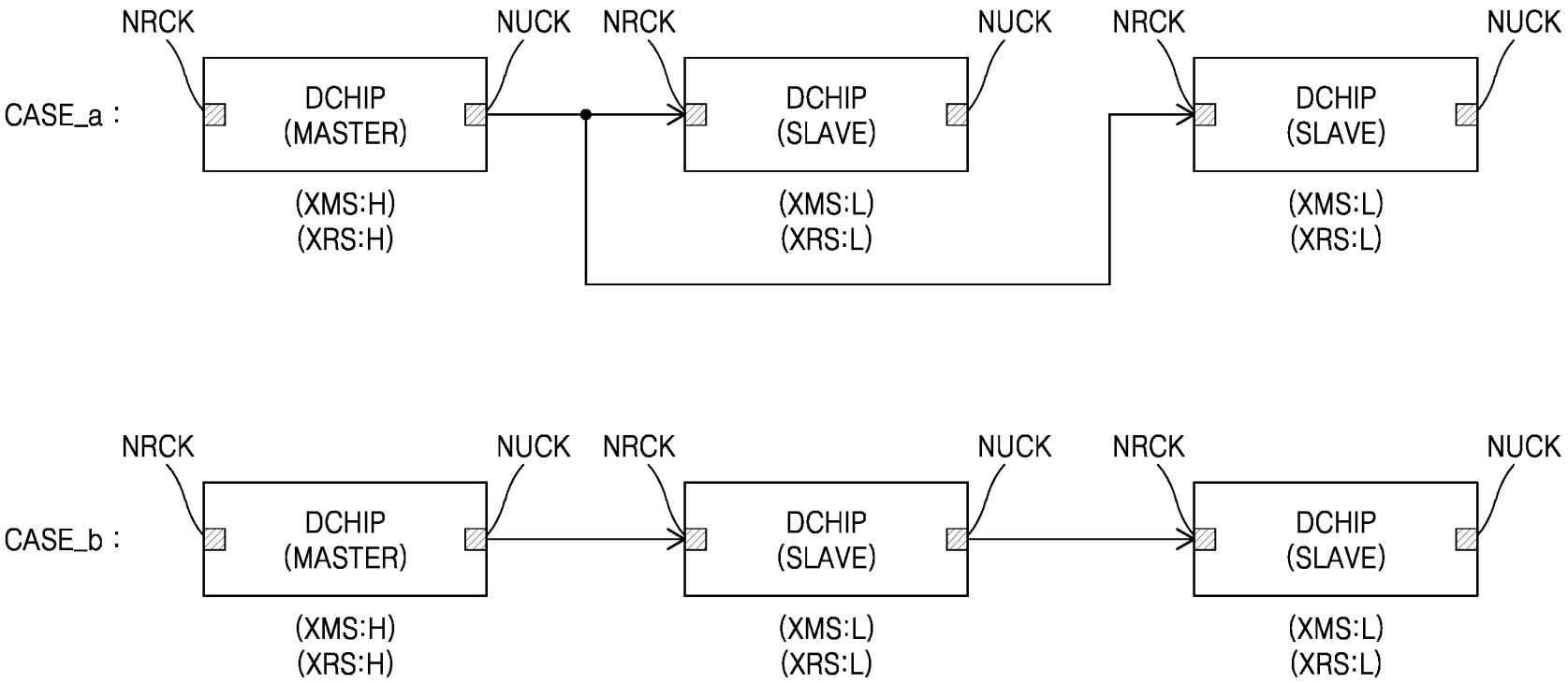
FIG. 7 is a schematic view for explaining that the LED driver chip of FIG. 1 is capable of being used for a master chip and a slave chip.

The LED driver chip DCHIP of the disclosure, as shown in FIG. 7, can be used for both a master chip and a slave chip.

FIG. 7 is a view for explaining that the LED driver chip of FIG. 1 is capable of being used for a master chip and a slave chip. In FIG. 7, one master LED driver chip and two slave LED driver chips are shown as an example.

CASE_a shows a so-called "parallel" structure. For example, all of the two slave LED driver chips 12 and 13 may receive the clock signal, which is provided from the clock output node NUCK of the master LED driver chip 11, with the clock reception node NRCK.

CASE_b shows a so-called "serial" structure. For example, a slave LED driver chip 22 may receive the clock signal, which is provided from the clock output node NUCK of the master LED driver chip 21, with the clock reception node NRCK. A slave LED driver chip 23 may receive the clock signal, which is provided from the clock output node NUCK of the slave LED driver chip 22, with the clock reception node NRCK.

In case that the LED driver chip DCHIP of the disclosure is used for the master, the reference determination signal XRS and the application selection signal XRS may be in a logic state of "H."

Accordingly, in the LED driver chip DCHIP of the disclosure which is used for the master, the strobe clock signal SCK may be used as a reference clock signal RCK. The 1-st to the n-th frequency clock signals FCK<1:n>, which are relatively simple to generate, may be provided as the 1-st to the n-th gray clock signals GCK<1:n>.

In case that the LED driver chip DCHIP of the disclosure is used for the slave, the reference determination signal XRS and the application selection signal XRS may be in a logic state of "L."

Accordingly, in the LED driver chip DCHIP of the disclosure which is used for the slaver, the external clock signal ECK may be used as a reference clock signal RCK. The 1-st to the n-th delay clock signals DCK<1:n>, which have a phase according to the reference clock signal RCK, are provided as the 1-st to the n-th gray clock signals GCK<1:n>.

For example, the LED driver chip DCHIP of the disclosure can be used for both a master chip and a slave chip.

The above description is an example of technical features of the disclosure, and those skilled in the art to which the disclosure pertains will be able to make various modifications and variations. Thus, the embodiments of the disclosure described above may be implemented separately or in combination with each other.

Therefore, the embodiments disclosed in the disclosure are not intended to limit the technical spirit of the disclosure, but to describe the technical spirit of the disclosure, and the scope of the technical spirit of the disclosure is not limited by these embodiments. The protection scope of the disclosure should be interpreted by the following claims, and it should be interpreted that all technical spirits within the equivalent scope are included in the scope of the disclosure.

What is claimed is:

1. An LED driver chip that drives a display panel, the LED driver chip comprising:

a clock reception node;

a reference determination multiplexer that provides at least one of an external clock signal and a strobe clock signal as a reference clock signal, the external clock signal being received from an outside through the clock reception node;

a gray clock generation part that generates a gray clock signal group, wherein the gray clock signal group corresponds to a delay clock signal group according to deactivation of an application selection signal, and corresponds to a frequency clock signal group according to activation of an application selection signal, the delay clock signal group includes a 1-st to a n-th delay clock signals which are sequentially delayed by a unit delay width with "n" being a natural number equal to or greater than 2, the frequency clock signal group includes a 1-st to a n-th frequency clock signals which are capable of being frequency-modulated with respect to the reference clock signal, frequencies of the 1-st to the n-th frequency clock signals are substantially identical to each other, and the gray clock signal group includes a 1-st to a n-th gray clock signals;

a clock modulation part that generates a modulation clock signal having a pulse width corresponding to a source data by using at least one of the 1-st to the n-th gray clock signals, the source data determining a light emission intensity of LED pixels disposed on the display panel;

a data line driving part that drives a data line of the display panel with a current amount corresponding to a pulse width of the modulation clock signal;

an output generation multiplexer that generates an output clock signal, the output clock signal being the n-th delay clock signal in case that the application selection signal is deactivated, and the output clock signal being the n-th frequency clock signal in case that the application selection signal is activated; and a clock output node that provides the output clock signal to the outside.

2. The LED driver chip of claim 1, wherein the source data is provided from the outside in synchronization with the strobe clock signal.

3. The LED driver chip of claim 1, wherein the gray clock generation part includes:

a delay locked loop that is enabled in response to deactivation of the application selection signal and generates the 1-st to the n-th delay clock signals, the 1-st to the n-th delay clock signals being sequentially delayed by the unit delay width with respect to the reference clock signal, and a phase of the n-th delay clock signal being substantially identical to a phase of the reference clock signal;

a frequency locked loop that is enabled in response to activation of the application selection signal and generates the 1-st to the n-th frequency clock signals; and a loop selection multiplexer that provides the 1-st to the n-th delay clock signals as the 1-st to the n-th gray clock signals according to deactivation of the application selection signal, and provides the 1-st to the n-th frequency clock signals as the 1-st to the n-th gray clock signals according to activation of the application selection signal.

4. The LED driver chip of claim 1, wherein a data value of the source data includes a main code value and an additional code value, and the pulse width of the modulation clock signal includes a main activation width and an additional activation width.

5. The LED driver chip of claim 4, wherein the main activation width of the modulation clock signal is a multiple of a clock width of the n-th gray clock signal, and the multiple of the clock width of the n-th gray clock signal corresponds to the main code value of the source data.

6. The LED driver chip of claim 5, wherein the additional activation width of the modulation clock signal is determined by using the activation width of at least one of the 1-st to a n-th gray clock signals.

7. An LED display device comprising:

a display panel; and

LED driver chips that drives the display panel, each of the LED driver chips comprising:

a clock reception node;

a reference determination multiplexer that provides at least one of an external clock signal and a strobe clock signal as a reference clock signal, the external clock signal being received from an outside through the clock reception node;

a gray clock generation part that generates a gray clock signal group, wherein the gray clock signal group corresponds to a delay clock signal group according to deactivation of an application selection signal, and corresponds to a frequency clock signal group according to activation of an application selection signal, the delay clock signal group includes a 1-st to a n-th delay clock signals which are sequentially delayed by a unit delay width with "n" being a natural number equal to or greater than 2, the frequency clock signal group includes a 1-st to a n-th frequency clock signals which are capable of being frequency-modulated with respect to the reference clock signal, frequencies of the 1-st to the n-th frequency clock signals are substantially identical to each other, and the gray clock signal group includes a 1-st to a n-th gray clock signals;

a clock modulation part that generates a modulation clock signal having a pulse width corresponding to a source data by using at least one of the 1-st to the n-th gray clock signals, the source data determining a light emission intensity of LED pixels disposed on the display panel;

a data line driving part that drives a data line of the display panel with a current amount corresponding to a pulse width of the modulation clock signal;

an output generation multiplexer that generates an output clock signal, the output clock signal being the n-th delay clock signal in case that the application selection signal is deactivated, and the output clock signal being the n-th frequency clock signal in case that the application selection signal is activated; and a clock output node that provides the output clock signal to the outside.

8. The LED display device of claim 7, wherein the source data is provided from the outside in synchronization with the strobe clock signal.

9. The LED display device of claim 7, wherein the gray clock generation part includes:

a delay locked loop that is enabled in response to deactivation of the application selection signal and generates the 1-st to the n-th delay clock signals, the 1-st to the n-th delay clock signals being sequentially delayed by the unit delay width with respect to the reference clock signal, and a phase of the n-th delay clock signal being substantially identical to a phase of the reference clock signal;

a frequency locked loop that is enabled in response to activation of the application selection signal and generates the 1-st to the n-th frequency clock signals; and a loop selection multiplexer that provides the 1-st to the n-th delay clock signals as the 1-st to the n-th gray clock signals according to deactivation of the application selection signal, and provides the 1-st to the n-th frequency clock signals as the 1-st to the n-th gray clock signals according to activation of the application selection signal.

10. The LED display device of claim 7, wherein a data value of the source data includes a main code value and an additional code value, and the pulse width of the modulation clock signal includes a main activation width and an additional activation width.

11. The LED driver chip of claim 10, wherein the main activation width of the modulation clock signal is a multiple of a clock width of the n-th gray clock signal, and the multiple of the clock width of the n-th gray clock signal corresponds to the main code value of the source data.

12. The LED driver chip of claim 11, wherein the additional activation width of the modulation clock signal is determined by using the activation width of at least one of the 1-st to a n-th gray clock signals.

13. The LED display device of claim 7, the LED driver chips include:

a first LED driver chip that functions as a master driver chip;

a second LED driver chip that functions as a slave driver chip; and a third LED driver chip that functions as another slave driver ship.

14. The LED display device of claim 7, wherein the first LED driver chip is electrically connected to the second LED driver chip and the third LED driver chip, and the second LED driver chip and the third LED driver chip are electrically connected in parallel.

15. The LED display device of claim 7, wherein the first LED driver chip is electrically connected to the second LED driver chip, and the second LED driver chip is electrically connected to the third LED driver chip.

* * * * *